US011555600B2

(12) United States Patent
Robbins

(10) Patent No.: US 11,555,600 B2
(45) Date of Patent: Jan. 17, 2023

(54) COMPONENTS, SYSTEMS, AND METHODS FOR HANGING STRANDS OF LIGHTS

(71) Applicant: Darrin M. Robbins, Griffith, IN (US)

(72) Inventor: Darrin M. Robbins, Griffith, IN (US)

( * ) Notice: Subject to any disclaimer, the term of this patent is extended or adjusted under 35 U.S.C. 154(b) by 0 days.

(21) Appl. No.: 17/173,521

(22) Filed: Feb. 11, 2021

(65) Prior Publication Data

US 2021/0247058 A1 Aug. 12, 2021

Related U.S. Application Data

(60) Provisional application No. 62/972,865, filed on Feb. 11, 2020.

(51) Int. Cl.

| | |
|---|---|
| ***F21V 21/088*** | (2006.01) |
| ***F21V 21/08*** | (2006.01) |
| ***F21V 21/096*** | (2006.01) |
| ***F21S 4/10*** | (2016.01) |

(52) U.S. Cl.

CPC ..... *F21V 21/088* (2013.01); *F21V 21/0808* (2013.01); *F21V 21/096* (2013.01); *F21S 4/10* (2016.01)

(58) Field of Classification Search

CPC .. F21V 21/088; F21V 21/0885; F21V 21/096; F21V 21/0965; F21S 4/10; F21S 4/15; F16B 2001/0035

See application file for complete search history.

(56) References Cited

U.S. PATENT DOCUMENTS

| | | | | |
|---|---|---|---|---|
| 4,635,886 A * | 1/1987 | Santucci | F16L 3/12 | 24/543 |
| 4,953,714 A * | 9/1990 | Paul | A47F 5/0884 | 211/36 |
| 5,230,489 A * | 7/1993 | White | F16L 3/233 | 24/16 PB |
| 5,441,224 A * | 8/1995 | Ludwig | F16L 3/22 | 248/74.2 |
| D389,730 S * | 1/1998 | Nakamura | D8/395 | |
| 6,352,229 B1 * | 3/2002 | Adams | A47G 1/17 | 24/67 R |
| 6,520,661 B1 * | 2/2003 | Hill | F21V 21/096 | 362/249.01 |
| 6,719,155 B1 * | 4/2004 | Chang | B25H 3/04 | 211/DIG. 1 |

(Continued)

*Primary Examiner* — Jong-Suk (James) Lee
*Assistant Examiner* — James M Endo
(74) *Attorney, Agent, or Firm* — Hartman Global IP Law; Gary M. Hartman; Domenica N. S. Hartman

(57) ABSTRACT

Components, systems, and methods for hanging an article, such as a strand of lights that has multiple lights physically and electrically connected together by one or more electrical wires. Such a system includes an elongated strip having a ferromagnetic material, a feature for attaching the elongated strip to a structure, and a number of hanging devices each having a base, a fastener located on a front side of the base, and a magnet mounted to a back side of the base. The fastener is configured to couple with a portion of the article, and the magnet is magnetically attracted to and releasably attachable to the ferromagnetic material of the elongated strip. The hanging devices in combination are configured to secure and suspend the article from the structure by magnetically attaching to the elongated strip.

11 Claims, 5 Drawing Sheets

(56) References Cited

U.S. PATENT DOCUMENTS

| | | | | |
|---|---|---|---|---|
| 7,997,773 | B2 * | 8/2011 | Kraus | H02G 3/24 362/396 |
| 8,020,810 | B2 * | 9/2011 | Dietrich | H02G 3/32 248/63 |
| 9,707,988 | B1 * | 7/2017 | Chanatski | B62B 9/005 |
| 10,228,114 | B1 * | 3/2019 | Payton | F21V 21/096 |
| 2009/0185370 | A1 * | 7/2009 | Moore | F21S 4/10 362/219 |
| 2009/0201685 | A1 * | 8/2009 | George | F21S 4/10 362/398 |
| 2010/0290240 | A1 * | 11/2010 | Genenbacher | F21V 21/096 362/398 |
| 2011/0305028 | A1 * | 12/2011 | Scott | F21S 4/10 362/398 |
| 2012/0056441 | A1 * | 3/2012 | Chavarria | H01F 7/0252 294/106 |
| 2012/0069587 | A1 * | 3/2012 | Holland | F21V 21/088 362/396 |
| 2012/0198680 | A1 * | 8/2012 | Durben | F16L 3/1218 29/428 |
| 2012/0280098 | A1 * | 11/2012 | Rinck | F21S 4/10 248/304 |
| 2013/0042958 | A1 * | 2/2013 | Spindler | F21V 21/0808 156/66 |
| 2015/0308616 | A1 * | 10/2015 | Abbott | F21V 21/096 248/206.5 |
| 2016/0047494 | A1 * | 2/2016 | Dickinson | F16B 1/00 248/74.2 |
| 2018/0051827 | A1 * | 2/2018 | Garvin | H01F 7/0221 |
| 2018/0058670 | A1 * | 3/2018 | Mitchell | D06F 55/02 |

* cited by examiner

COMPONENTS, SYSTEMS, AND METHODS FOR HANGING STRANDS OF LIGHTS

CROSS-REFERENCE TO RELATED APPLICATIONS

This application claims the benefit of U.S. Provisional Application No. 62/972,865 filed Feb. 11, 2020, the contents of which are incorporated herein by reference.

BACKGROUND OF THE INVENTION

The present invention generally relates to components, systems, and methods for hanging strands of lights.

Holiday lights are traditionally hung on the exterior of buildings during the holiday seasons and then removed after the holidays have passed. However, hanging holiday lights can be time consuming and, depending on what types of fasteners are used (e.g., staples, nails, etc.), may cause damage to a building exterior. Various attempts have been made to promote ease of hanging and removing holiday lights, such as clips or other fasteners that couple with gutters. However, these devices are not always easy to use, may have limited durability, and may be limited in the types of surfaces to which they can be attached.

Lights, banners, signs, decorations, etc., used for other occasions and celebrations encounter similar issues as described above for holiday lights. Therefore, it can be appreciated that it would be desirable if improved systems and methods were available for hanging various types of articles to at least partly overcome or avoid the problems, shortcomings or disadvantages associated with traditional methods of hanging such articles.

BRIEF SUMMARY OF THE INVENTION

The present invention provides components, systems, and methods suitable for hanging various types of articles, including but not limited to strands of lights that have multiple lights physically and electrically connected together by one or more electrical wires.

According to one aspect of the invention, a system for hanging an article includes an elongated strip comprising a ferromagnetic material, means for attaching the elongated strip to a structure, and a plurality of hanging devices each comprising a base, a fastener located on a front side of the base, and a magnet mounted to a back side of the base. The fastener is configured to couple with a portion of the article, and the magnet is magnetically attracted to and releasably attachable to the ferromagnetic material of the elongated strip. The hanging devices in combination are configured to secure and suspend the article from the structure by magnetically attaching to the elongated strip.

According to another aspect of the invention, a method of hanging an article includes attaching an elongated strip to a structure, and securing the article to a plurality of hanging devices. Each hanging device comprises a base, a fastener located on a front side of the base, and a magnet mounted to a back side of the base. The fastener couples with a portion of the article, and the hanging devices are secured to the elongated strip by magnetically attaching the hanging devices to the elongated strip with the magnets thereof so that the hanging devices in combination secure and suspend the article from the structure.

Technical effects of the system and method described above preferably include the ability to quickly and easily hang strands of lights from various surfaces. For example, the elongated strip can be semi-permanently attached to a building so that a strand of lights with the hanging devices coupled thereto can be magnetically secured to the elongated strip.

Other aspects and advantages of this invention will be appreciated from the following detailed description.

DETAILED DESCRIPTION OF THE INVENTION

FIGS. 1 through 7 represent various aspects of components, systems, and methods for hanging various types of articles, including but not limited to decorative lights (e.g., wires, ropes, cords, etc.), banners, signs, decorations, etc., used for various occasions and celebrations, from a support structure, for example, a portion of a building. For convenience, the components, systems, and methods will be discussed in reference to hanging a light strand 20 (FIGS. 4 and 5) comprising multiple lights 22 physically and electrically connected together by one or more electrical wires 21 so that the lights 22 are spaced apart along the length of the wires 21. However, the invention is not limited to light strands, and more broadly can be used to hang various articles, including those noted above, by engaging a portion of such articles, for example, a wire, string, cord, grommet, loop, or other feature that can be captured by a component of the system.

Figure 1:
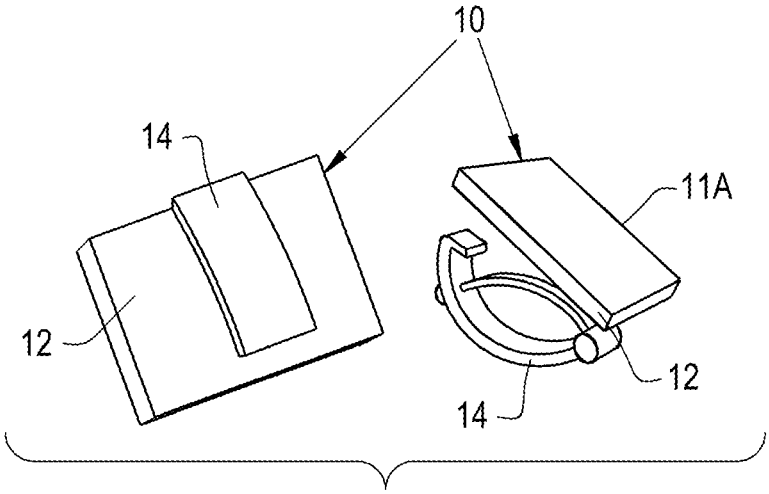
FIG. 1 schematically represents front and back perspective views of hanging devices for hanging strands of lights on a structure in accordance with nonlimiting aspects of the invention.

The systems include a plurality of hanging devices 10 (FIGS. 1 and 2) that each comprise a base 12, a fastener 14 (e.g., clip, hook, etc.) located on a front side of the base 12, and a magnet 16 (FIG. 2) attached or otherwise mounted to a back side of the base 12. The fastener 14 is configured to couple with a portion of the light strand 20, for example, by clipping to or otherwise securing portions of the wires 21 between two adjacent lights 22. The magnet 16 is preferably a permanent magnet, for example, a rare earth magnet, that is magnetically attracted to and releasably attachable to ferromagnetic materials. In the embodiment represented in FIGS. 1 and 2, each base 12 of the hanging devices 10 has a relatively planar shape and a release film 11A (FIG. 1)

covers a film 11B (FIG. 2) of an adhesive material with which the magnet 16 may be adhered to the back side of the base 12. Alternatively, the base 12 and/or film 11B may comprise or be formed of a ferromagnetic material with which the magnet 16 may be magnetically attached to the back side of the base 12.

Figure 3:
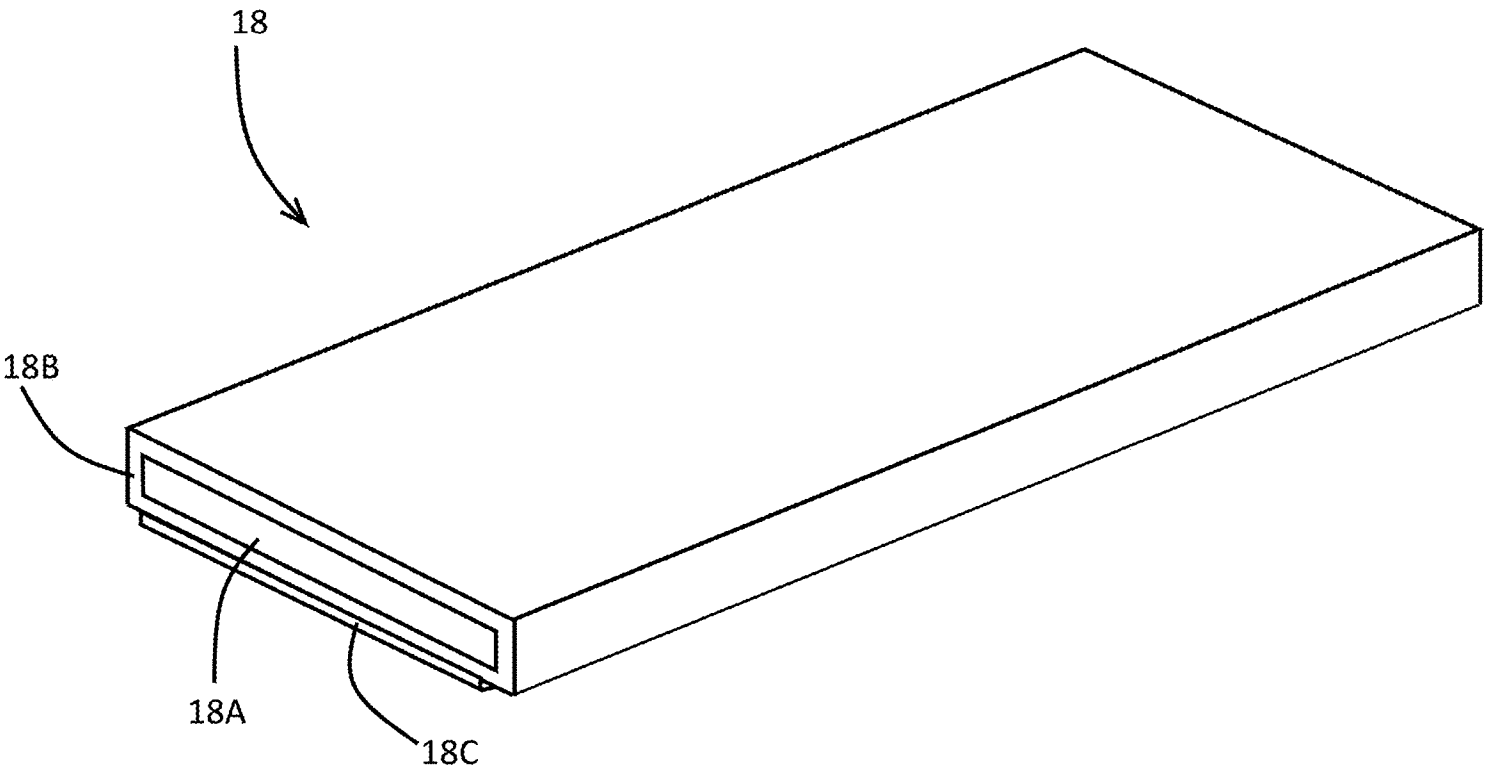
FIG. 3 schematically represents an elongated ferromagnetic strip for use in combination with the hanging devices of FIGS. 1 and 2 in accordance with a nonlimiting aspect of the invention.

In use, the light strand 20 may be hung from a structure by coupling any number of the hanging devices 10 along the length of the wires 21 and then fixing each of the hanging devices 10 to the surface. If the surface of the structure is or contains a ferromagnetic material, the hanging devices 10 can be magnetically and releasably attached to the surface via direct contact between the surface and the magnet 16 of each device 10. If the surface is not or does not contain a ferromagnetic material, an elongated strip 18 (FIG. 3) containing a ferromagnetic material is first mounted to the surface of the structure, enabling the hanging devices 10 may be magnetically and releasably attached to the structure via direct contact between the elongated strip 18 and the magnet 16 of each device 10 as a result of the magnet 16 being magnetically attracted to and releasably attachable to the ferromagnetic material of the strip 18. FIG. 3 represents the strip 18 as comprising a continuous ferromagnetic band 18A encased by a polymer casing 18B. Suitable means for attaching the elongated strip 18 to a structure include a pressure adhesive 18C that may be pre-applied to one surface of the strip 18, as well as such common means as permanent adhesive, staples, tacks, nails, etc., applied by a user. Suitable structural strengths for the fasteners 14, magnetic strengths for the magnets 16, adhesive strengths for the adhesive 18C (or other attaching means), and numbers of hanging devices 10 used to hang a light strand 20 (or other article) will depend in part on the weight and length of the light strand 20 (or other article).

Figure 4:
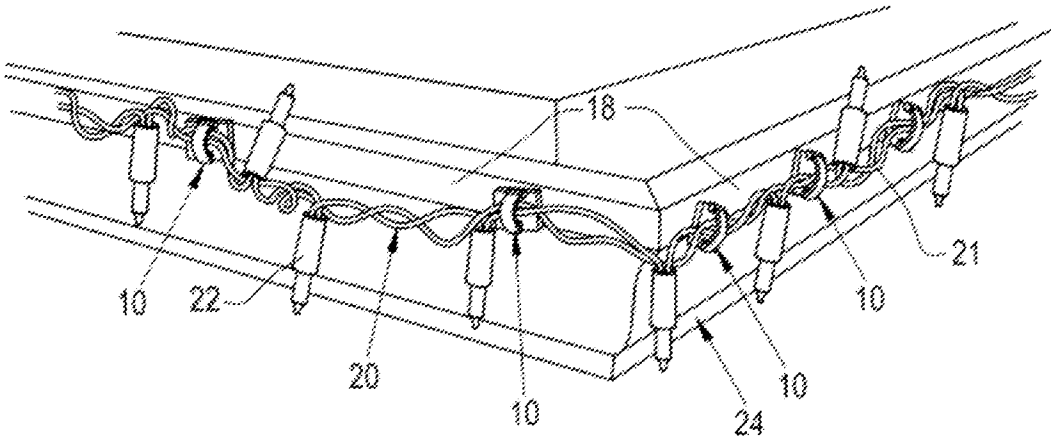
FIGS. 4 and 5 schematically represent a strand of lights magnetically mounted to, respectively, a gutter and a window frame using the hanging devices and elongated strip of FIGS. 1 through 3 in accordance with a nonlimiting aspect of the invention.
Figure 5:
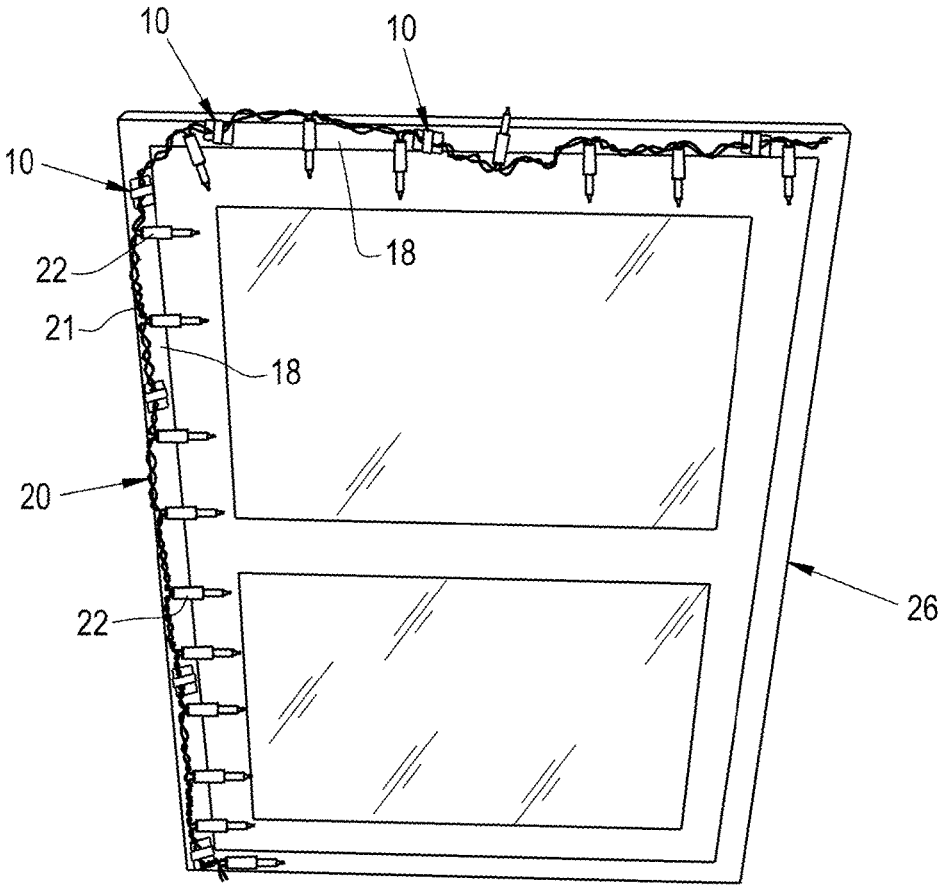

With the use of the elongated strip 18, the system is capable of securing and suspending an article from various surfaces made of magnetic and nonmagnetic materials, including but not limited to metals, polymers, ceramics, composites, and wood commonly used in the construction of various structures, including but not limited to the exterior surfaces of buildings including but not limited to exterior walls, roofs, gutters, soffits, brick mold, drip edges, siding (including aluminum and polyvinyl chloride (PVC) siding), exterior surfaces of windows and window frames, and exterior door trim, and interior surfaces of buildings including interior walls, ceilings, kitchen cabinets, interior surfaces of windows and window frames, interior door trim, and furniture. FIGS. 4 and 5 schematically represent a light strand 20 magnetically mounted to, respectively, a gutter 24 and a window frame 26 using multiple elongated strips 18 and a plurality of the hanging devices 10 of FIGS. 1 through 3. For exterior applications, the elongated strip(s) 18 may incorporate a resistive heating element, for example, a heat tape or cable to generate heat for melting ice and snow from around the light strand 20.

Figure 2:
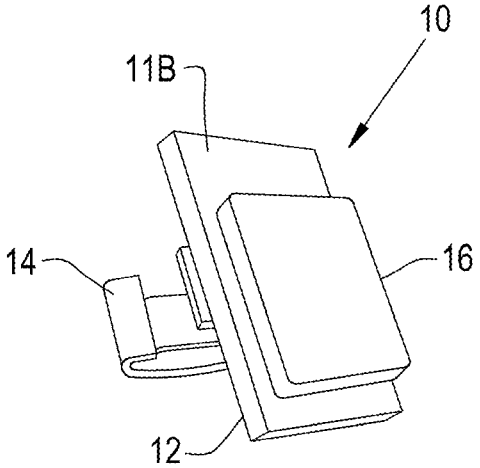
FIG. 2 schematically represents a magnet adhesively attached to a back surface of one of the hanging devices of FIG. 1 in accordance with a nonlimiting aspect of the invention.
Figure 6:
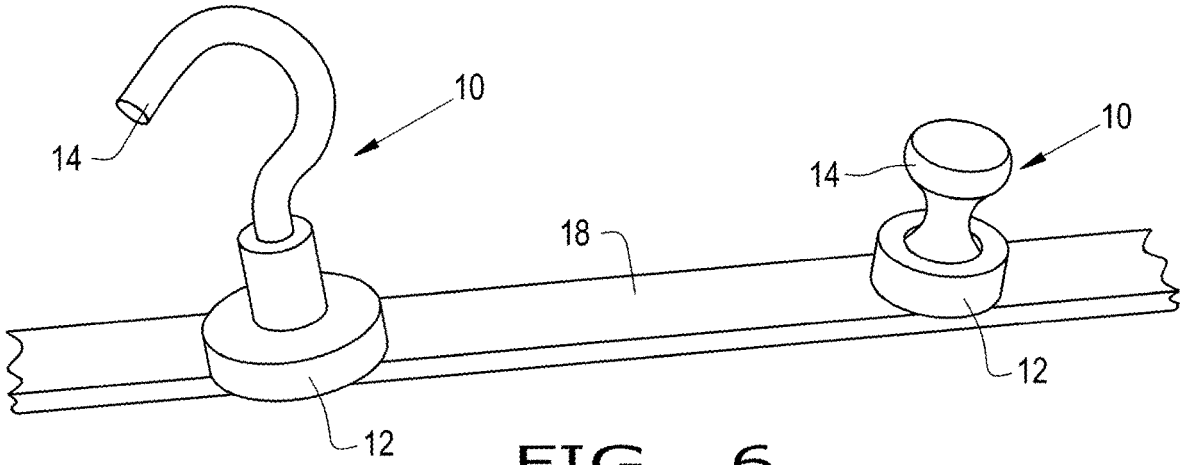
FIG. 6 schematically represents additional hanging devices magnetically mounted to the elongated strip of FIG. 3 in accordance with nonlimiting aspects of the invention.

FIG. 6 schematically represents two additional configurations for the hanging device 10 of FIGS. 1 and 2. The fastener 14 of the device 10 on the lefthand side of FIG. 6 comprises a hook mounted to a base 12 containing a magnet (not shown), and the fastener 14 of the device 10 on the righthand side of FIG. 6 comprises a knob mounted to a base 12 containing a magnet (not shown).

Figure 7:
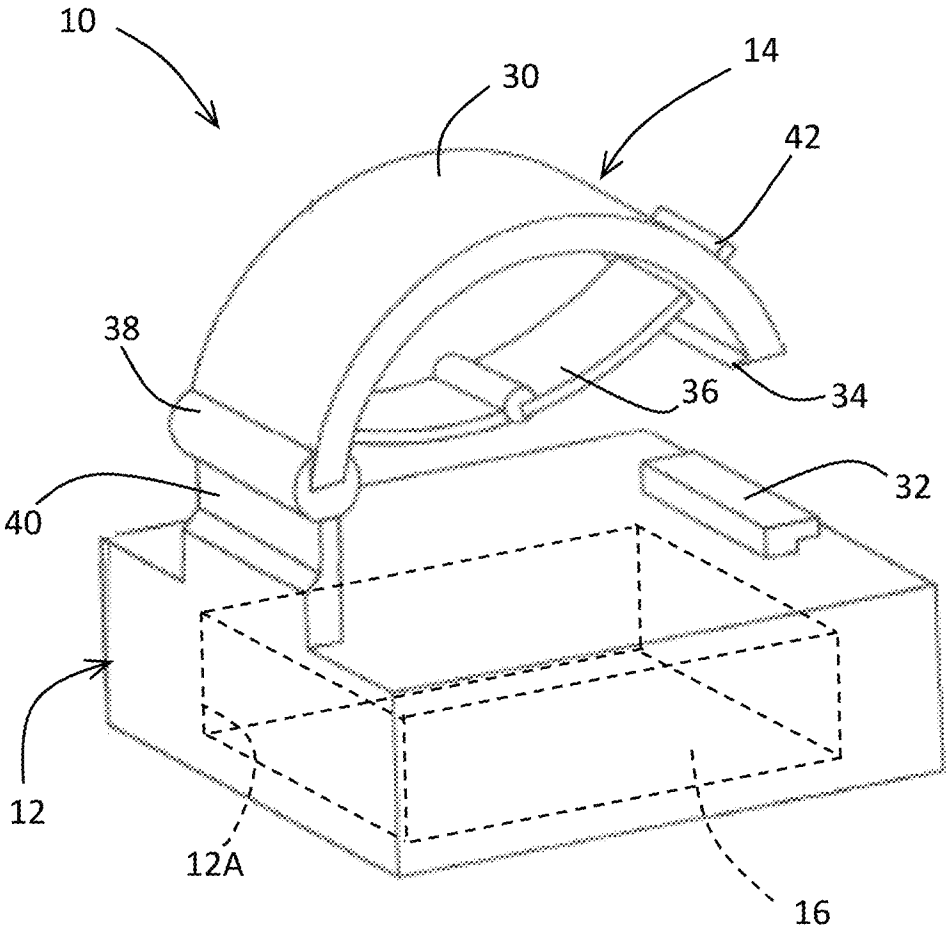
FIG. 7 schematically represents a perspective view of an additional hanging device for hanging strands of lights on a structure in accordance with a nonlimiting aspect of the invention.

The fasteners 14 (e.g., clips, hooks, knobs, etc.) of the hanging devices 10 of FIGS. 1, 2, and 6 are preferably configured to enable a light strand 20 to be quickly coupled and removed from the devices 10 by disengaging the wires 21 of the strand 20 from the fasteners 14. In the case of a simple clip, hook, or knob, the wires 21 may be unintentionally disengaged from the devices 10, for example, if used outdoors and exposed to wind. FIG. 7 schematically represents an alternative hanging device 10 with more durable means for securing a portion of an article, such as the wire of a light strand. Similar to the hanging devices 10 of FIGS. 1, 2, and 6, the hanging device 10 of FIG. 7 comprises a base 12, a fastener 14 located on a front side of the base 12, and a magnet 16 mounted to a back side of the base 12. The base 12 of FIG. 7 differs from that of the embodiment represented in FIGS. 1 and 2 by providing a cavity or recess 12A in which the magnet 16 is received and may be permanently secured, for example, with an adhesive or by an interference fit. The fastener 14 of FIG. 7 differs from that of the embodiments represented in FIGS. 1, 2, and 6 by comprising a clamping arm 30 adapted to engage a latch 32 on the top side of the base 12. The latch 32 is configured to releasably capture a latching feature 34 located near or at the distal end of the arm 30. The arm 30 has an arcuate shape, generally concave on a side thereof facing the top surface of the base 12, and is pivotally coupled at a hinge 38 to a pedestal 40 projecting upward from the base 12. The fastener 14 further comprises a biasing member 36 that projects inward from the arm 30 toward the base 12. In the nonlimiting embodiment shown in FIG. 7, the biasing member 36 is an elastic spring having a convex shape facing the top surface of the base 12. The biasing member 36 is shown as coupled to the arm 30 at the hinge 38 as well as a mount 42 located in proximity to the distal end of the arm 30. The biasing member 36 protrudes a sufficient distance from the arm 30 so that when the arm 30 is engaged with the latch 32, the biasing member 36 may contact or at least be in proximity to the top surface of the base 12. In this manner, the wires 21 of a light strand 20 (or other suitably-sized portion of an article) placed between the arm 30 and the top surface of the base 12 can be captured and clamped between the base 12 and the biasing member 36 of the arm 30 as a result of the biasing member 36 contacting and more preferable being compressed and deflected toward the arm 30 as a result of engaging the wires 21. Release of the light strand 20 from the fastener 14 is achieved by disengaging the arm 30 from the latch 32, which is unlikely to unintentionally occur from the action of wind.

Although the hanging devices 10 have been described in reference to hanging strands of lights 20, they are capable of and may be configured for hanging various articles, nonlimiting examples of which may include banners, signs, celebration decorations, etc., by using the fastener 14 to capture a wire, string, cord, grommet, loop, or other feature of the article.

While the invention has been described in terms of particular embodiments, it should be apparent that alternatives could be adopted by one skilled in the art. For example, the hanging devices 10 and their components could differ in appearance and construction from the embodiments described herein and shown in the drawings, functions of certain components of the hanging devices 10 could be performed by components of different construction but capable of a similar (though not necessarily equivalent) function, and various materials could be used in the fabrication of the hanging devices 10, elongated strip 18, and/or their components. As such, it should be understood that the intent of the above detailed description is to describe the particular embodiments represented in the drawings and certain but not necessarily all features and aspects thereof, and to identify certain but not necessarily all alternatives to the particular embodiments represented in the drawings. As a nonlimiting example, the invention encompasses additional or alternative embodiments in which one or more features or aspects of a particular embodiment could be eliminated or two or more features or aspects of different described embodiments could be combined. Accordingly, it should be understood that the invention is not necessarily limited to any particular embodiment described herein or illustrated in the drawings. It should also be understood that the purpose of the above detailed description and the phraseology and terminology employed therein is to describe the illustrated embodiments represented in the drawings, and not necessarily to serve as limitations to the scope of the invention. Therefore, the scope of the invention is to be limited only by the following claims.

The invention claimed is:

1. A system for hanging a light strand having an electrical wire connecting a plurality of lights, the system comprising:

an elongated strip having a length, a width, and a thickness that is less than the width of the elongated strip, the elongated strip comprising oppositely-disposed first and second outer surfaces defining the thickness of the elongated strip, a ferromagnetic material formed as a continuous band that is continuous along the length of the elongated strip and has oppositely-disposed first and second surfaces facing, respectively, the first and second outer surfaces of the elongated strip, and a polymer casing that defines the first and second outer surfaces of the elongated strip, encases the ferromagnetic material, and contacts the first and second surfaces of the ferromagnetic material;

a plurality of hanging devices each comprising a base, a fastener located on a front side of the base, and a magnet permanently secured within a cavity at a back side of the base, the fastener comprising a clamping arm pivotably coupled to the base of the first hanging device, a latch for releasably securing the clamping arm to the base when the clamping arm is in a latched position, and an elastic spring that projects toward the base, protrudes a sufficient distance from the clamping arm to clamp the electrical wire of the light strand between the elastic spring and the base when the clamping arm is in the latched position, and releases the electrical wire when the clamping arm is unlatched and in a released position, the magnet being releasably attachable to the first outer surface of the elongated strip by being magnetically attracted to the ferromagnetic material of the elongated strip through a thickness of the polymer casing at the first outer surface of the elongated strip; and an adhesive adhered to the second outer surface of the elongated strip for attaching the elongated strip to a structure;

wherein the hanging devices in combination secure and suspend the light strand from the structure by magnetically attaching to the elongated strip at any location along the length thereof.

2. The system of claim 1, wherein the clamping arm has an arcuate concave surface facing the base of the first hanging device.

3. The system of claim 2, wherein the elastic spring has an arcuate convex surface that faces away from the arcuate concave surface of the clamping arm, faces the base of the first hanging device and protrudes from the arcuate concave surface of the clamping arm.

4. The system of claim 3, wherein the base has a planar surface that faces the arcuate convex surface of the elastic spring so that the electrical wire of the light strand is clamped between the arcuate convex surface of the elastic spring and the planar surface of the base when the clamping arm is in the latched position.

5. The system of claim 1, wherein the adhesive is operable to attach the elongated strip to a metallic, polymer, ceramic, composite, or wood surface of the structure.

6. A method of hanging a light strand having an electrical wire connecting a plurality of lights, the method comprising:

providing an elongated strip having a length, a width, and a thickness that is less than the width of the elongated strip, the elongated strip comprising oppositely-disposed first and second outer surfaces, a ferromagnetic material formed as a continuous band that is continuous along the length of the elongated strip and having oppositely-disposed first and second surfaces facing, respectively, the first and second outer surfaces of the elongated strip, and a polymer casing that defines the first and second outer surfaces of the elongated strip, encases the ferromagnetic material, and contacts at least the first surface of the ferromagnetic material;

attaching the second outer surface of the elongated strip to a structure;

securing the light strand to a plurality of hanging devices, each of the hanging devices comprising a base, a fastener located on a front side of the base, and a magnet permanently secured within a cavity at a back side of the base, the fastener comprising a clamping arm pivotably coupled to the base of the hanging device, a latch for releasably securing the clamping arm to the base when the clamping arm is in a latched position, and an elastic spring that projects toward the base, protrudes a sufficient distance from the clamping arm to clamp the electrical wire of the light strand between the elastic spring and the base when the clamping arm is in the latched position, and releases the electrical wire when the clamping arm is unlatched and in a released position, the securing of the light strand comprising placing the electrical wire of the light strand between the base and the clamping arm and then pivoting the clamping arm to clamp the electrical wire with the elastic spring and latch the clamping arm to the base with the latch; and securing the hanging devices to the elongated strip by magnetically attaching the hanging devices to the elongated strip with the magnets thereof via direct contact between the elongated strip and the magnet so that the hanging devices in combination secure and suspend the light strand from the structure, the magnets being releasably attached to the first outer surface of the elongated strip by being magnetically attracted to the ferromagnetic material of the elongated strip through a thickness of the polymer casing at the first outer surface of the elongated strip at any location along the length thereof.

7. The method of claim 6, wherein the clamping arm has an arcuate concave surface facing the base of the first hanging device.

8. The method of claim 7, wherein the elastic spring has an arcuate convex surface that faces away from the arcuate concave surface of the clamping arm, faces the base of the first hanging device and protrudes from the arcuate concave surface of the clamping arm.

9. The method of claim 8, wherein the base has a planar surface that faces the arcuate convex surface of the elastic spring so that the electrical wire of the light strand is clamped between the arcuate convex surface of the elastic spring and the planar surface of the base when the clamping arm is in the latched position.

10. The method of claim 6, wherein the elongated strip is attached with adhesive to a metallic, polymer, ceramic, composite, or wood surface of the structure.

11. The method of claim 10, wherein the structure is chosen from the group consisting of an exterior wall, roof, gutter, soffit, brick mold, drip edge, siding, an interior or exterior surface of window, a window frame, interior kitchen cabinet, interior or exterior door trim, interior ceiling or wall, or furniture.

* * * * *